United States Patent [19]

Wirz

[11] 4,122,773

[45] Oct. 31, 1978

[54] CHANGE-OVER MEANS FOR A STORAGE DRUM FOR SHEET TRANSFERRAL

[75] Inventor: Arno Wirz, Bammental, Germany

[73] Assignee: Heidelberger Druckmaschinen AG, Heidelberg, Germany

[21] Appl. No.: 789,009

[22] Filed: Apr. 20, 1977

Related U.S. Application Data

[63] Continuation of Ser. No. 571,257, Apr. 24, 1975, abandoned.

[30] Foreign Application Priority Data

Apr. 24, 1974 [DE] Fed. Rep. of Germany ..... 2419747

[51] Int. Cl.[2] ..... B41F 5/02; B41F 1/30

[52] U.S. Cl. ..... 101/230; 101/410

[58] Field of Search ..... 101/230, 231, 232, 183, 101/408, 409, 410; 271/82, 277

[56] References Cited

U.S. PATENT DOCUMENTS

| | | | |
|---|---|---|---|
| 2,757,610 | 8/1956 | Gegenheimer et al. | 101/230 X |
| 3,772,990 | 11/1973 | Weisgerber | 101/230 |
| 3,796,154 | 3/1974 | Weisgerber | 101/230 X |
| 4,014,261 | 3/1977 | Becker | 101/230 |

OTHER PUBLICATIONS

German Offenlegungsschrift No. 2419747 published 11-6-75 to Wirz.

*Primary Examiner*—Ronald E. Suter
*Attorney, Agent, or Firm*—Herbert L. Lerner

[57] ABSTRACT

An assembly of a sheet-transfer drum, a sheet-turning drum and a storage drum located therebetween for transporting a sheet between individual printing units of a rotary printing press includes a change-over mechanism for converting the printing press from single-side sheet printing to double-side perfector printing and conversely as well as to different format sizes. The change-over mechanism has a control shaft axially displaceable to at least first and second control positions, first and second control pinions mounted on the control shaft, and a plurality of drive wheels couplable with the first control pinion in the first control position of the control shaft, for converting the printing press from single-side sheet printing to double-side perfector printing. A device for guiding and holding a sheet is disposed on the storage drum. A gripper release device for adjusting the format size for perfector printing, and a control member coupled with the gripper-release device are also provided. The first control pinion, in the second control position of the control shaft, meshes with one of the drive wheels for adjusting the device for guiding and holding a sheet, and the second control pinion, in the second control position of the control shaft, meshes with the control member for adjusting the format size.

15 Claims, 11 Drawing Figures

Fig. 1
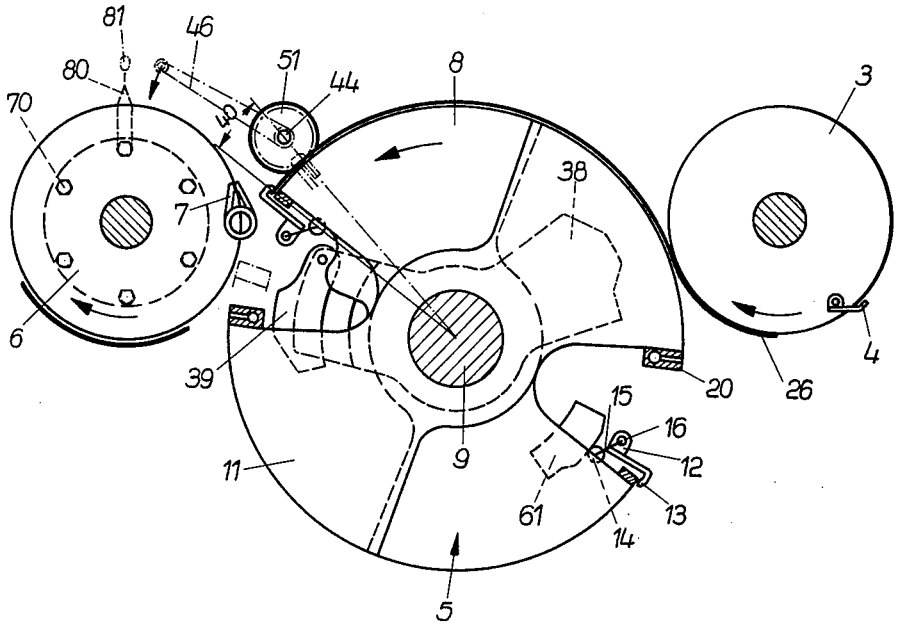
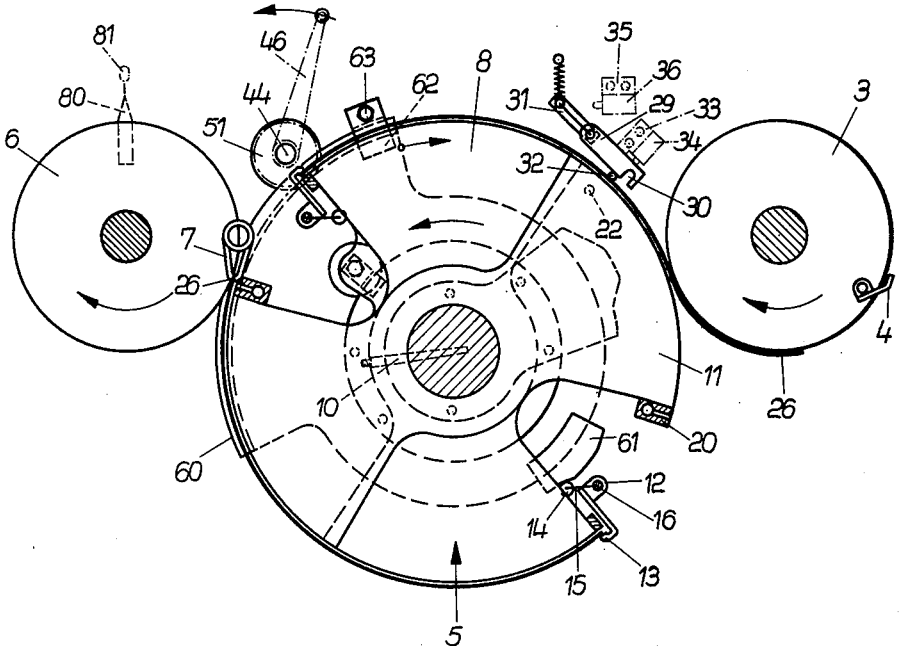
Fig. 2

Fig. 5
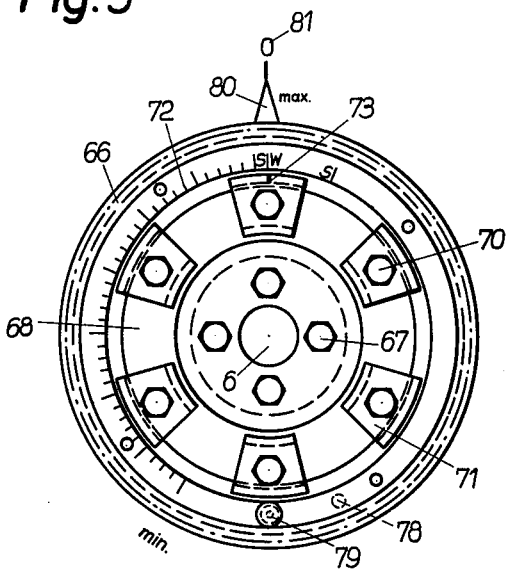
Fig. 6
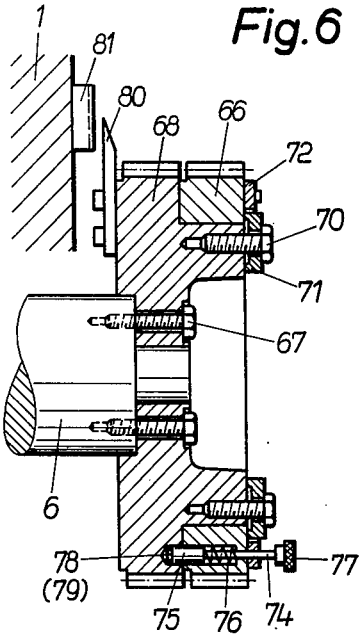
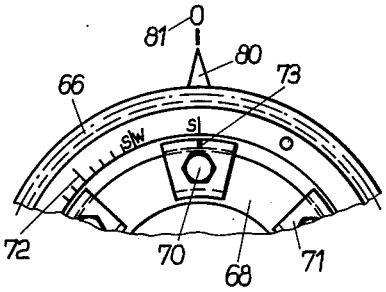
Fig. 7
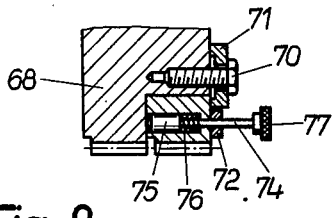
Fig. 8
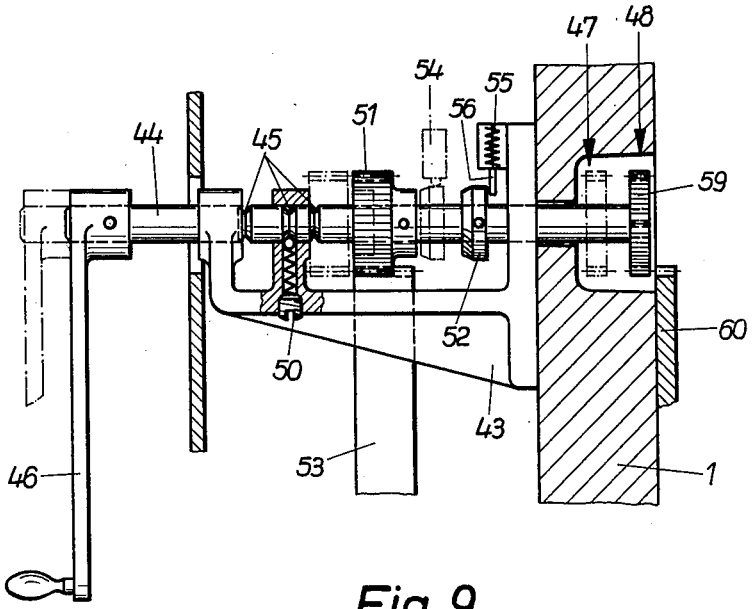
Fig. 9

CHANGE-OVER MEANS FOR A STORAGE DRUM FOR SHEET TRANSFERRAL

This is a continuation, of application Ser. No. 571,257, filed Apr. 24, 1975, now abandoned.

The invention relates to a storage drum disposed between a sheet transfer and a sheet-turning drum for transporting a sheet between individual printing units of a sheet-rotation or rotary printing press, the storage drum having a diameter double that of the respective transfer and turning drums, for converting the printing press from printing on a single side of a sheet to bothside perfector printing as well as to different format sizes.

In all convertible perfector printing machines, mechanisms of this type are required. The sheet to be imprinted is transferred during the travel thereof in the course of perfector printing from a first drum, namely, a transfer drum to a second transfer drum, namely, a storage drum, having a diameter double that of the first transfer drum, and is passed from the storage drum with the leading edge of the sheet disposed at the tangential point between the transfer drum of double diameter i.e. the storage drum and the next succeeding sheet-turning drum. As soon as the trailing edge of the sheet held by the suction members has reached the aforementioned tangential point, it is gripped by the gripping mechanism of the sheet-turning drum. At the same time, the leading edge of the sheet is released by the forward grippers and the sheet is transferred, with the trailing edge thereof extending frontwards, to the next impression cylinder. Heretofore known change-over means of this general type have complicated mechanisms, which are difficult to observe and therefore lead to uncertainties for operating personnel. The change-over must be affected from different points of the printing press through respective associated but separate change-over means and indicator scales, due to which differences are produced. Depending upon the number of such change-over means, the resultant inaccuracies are additive and have a disadvantageous effect on the quality of the print. Thus, inaccuracies in registration result, for example, during perfector printing, which require corrections during a change-over, and possibly produce additional sources of error.

The change-over of the various individual functions additionally demands a high degree of responsibility of the attending personnel and furthermore an increased expenditure of time to effect such a change-over, so that the productivity of the machine is considerably reduced. The individual change-over adjustments furthermore have a disadvantageous effect upon the operating reliability of the machine, so that the omission of a single important individual adjustment presents the danger of possible damage to the printing press.

Furthermore, a great number of different tools is required for the individual change-over operations in some heretofore known change-over mechanisms, which further increases the complexity of the change-over, and consequently the uncertainty of the operating personnel.

In German Pat. No. 1 107 246, a sheet-rotation or rotary printing machine with a plurality of printing units connected to each other by transfer cylinders is described, the transfer cylinders being provided with first and second gripper sets which can be actuated selectively.

In a heretofore known construction of this type, the several individual functions must be changed-over in sequence by means of separate adjusting members. Thus, upon a system change-over of the printing press, for example, from printing on a single side of a sheet to perfector printing, the relative angular adjustment or phase angle of the individual printing units must be effected initially. Subsequently, a cam disc specifically for two-color printing alone must be swung by a manual lever into a rest position outside the circular track of a pair of cam rolls, and a second cam disc required only for perfector printing must be adjusted along the track thereof in such a manner that the cam crest or lobe thereof controls the timing of the gripper release through the cam rolls. Separate therefrom, the suction head groups holding the trailing edge of the sheet must be adjusted to the following end of the sheet.

As a result of the great number of these adjustments which must moreover be effected by separate change-over means from various points located outside the printing press and which are readable from a plurality of adjustment discs associated with respective control means, differences and inaccuracies will necessarily arise in the course of the adjustments. Furthermore, as a result of the change-over of the different individual functions, the uncertainty of the operating personnel is increased, and one cannot exclude the possibility of damage occurring to the machine if an important single adjustment is omitted. Furthermore, the machine requires down-time periods during change-over that are relatively lengthy and result in lower productivity of the machine.

The cam required only for perfector printing remains in an operating position even during single-side sheet printing and thus causes an unnecessary release of the gripper, which in turn produces unnecessarily high wear thereof.

A sheet transfer device for a sheet-rotation or rotary printing machine having a plurality of printing units respectively connected by three transfer cylinders and containing an improved changeover means has become known from German Published Prosecuted Application DT-AS No. 2 126 258. In this known construction, a gripper release cam is disposed at the middle transfer cylinder, which results in the release of the gripper upon transfer of the sheet to a third transfer cylinder and therefore is applicable for both printing on a single side of a sheet as well as for perfector or double-side printing. It is peripherally adjustable, jointly or in common with a toothed segment-ring rigidly connected therewith and having an outer toothing, through a gear by means of an adjusting member, for example, a manual wheel, and is arrestable by means of a toothed segment.

The simultaneous employment of the gripper release cam both for printing on a single side of a sheet or for perfector printing requires a large adjustment range corresponding to that of the maximum format size. Actually, it is this long change-over path which makes the combination of several control functions difficult. Furthermore, all change-over and consequent down-time periods of the machine are considerably increased thereby.

The step-wise adjustment of the instant of opening of the gripper fields of the transfer cylinder corresponding to the circular pitch of the tooth segment ring and the tooth segment is additionally disadvantageous. Since the circular pitch $t_O = m \cdot \pi$, wherein m is the variable, it follows therefore that with a variable equal to 2, the circular pitch is approximately 6 mm. In view of this coarse or imprecise adjustment, the sheet transfer can be impaired by a sheet release which is either too early or too late, which undoubtedly leads to disruptions or disturbances in the printing process. Thus, for example, if a sheet is released too late, it can be damaged or torn due to the position of the sheet-turning grippers.

With the take-over of the sheet at the leading edge thereof, the sheet must first pass the gripper point, requiring a relatively large opening angle of the gripper, whereas, during perfector printing of the sheet, the gripper must be opened a distance only slightly greater than the maximal sheet thickness. Concurrent use of the gripper release cam for printing on a single side of the sheet and for perfector printing and the ensuing unnecessarily large gripper opening for perfector printing results in greater wear of parts effecting the opening and closing of the gripper, such as for example, the gripper shaft, the gripper bearing and the like.

Disregarding these disadvantages, to change-over the system of the machine from printing on a single side of the sheet to perfector printing or printing both sides of the sheet, several change-over operations with respective separate change-over means at various locations outside the machine are necessary. Additionally, the suction members holding the end of the sheet are not included in the change-over operation; they must be adjusted instead with separate control elements towards the end of the sheet.

German Pat. No. 1 611 241 discloses a sheet-transfer cylinder for printing presses wherein the preceding leading edge of the sheet and the following trailing edge of the sheet are respectively gripped by devices movable in the direction of rotation of the cylinder. The devices gripping the trailing edge of the sheet take the form of suction and blowing heads disposed on respective shaft support discs that are adjustable by means of a ring-shaped support member. By turning this support member relative to the shaft of the transfer cylinder, the suction and blowing heads can be moved in direction towards and away from these grippers and consequently adjusted to the trailing edge of respective paper sheets of varying lengths.

The adjustment range of this device is limited, however, since the adjustment can only be made within the limits of circular elongated holes, which are formed in sheet-supporting discs fastened on the shaft of the transfer cylinder, and in which vacuum arm shafts to which the suction and blowing heads are secured, move in a circumferential direction.

Additionally, the relative rotation of the printing units in a separate adjustment operation must be effected with separate adjustment means. Therefore, the heretofore mentioned possibility of error, the danger due to the omission of an adjustment of a single function of the machine, as well as the uncertainty of the personnel are not removed by the aforedescribed heretofore known device.

In a similar heretofore known device according to German Non-prosecuted Published Application No. 2 228 671 for gripping a paper sheet on a transfer cylinder of a printing press for multicolor printing as well as for perfector printing, the system change-over or format change-over of the machine is accomplished by rotation of a pinion, by means of which an adjustable ring-shaped segment to which the gripper cam is fastened can be changed over. The cam attached to the ring-shaped segment thus cooperates with two rollers which, in turn, control the grippers by means of levers. The magnitude of the rotation is visually readable on a scale by means of a pointer.

The suction members are automatically changed over during this adjustment operation, so that the distance between the suction members and the grippers of the succeeding transfer drum is not changed. But this process is only valid for a change-over of a single individual adjustment of the machine, however. For example, during perfector printing, the adjustment to the format to be processed must be made in a separate operation. The aforementioned difficulties are certainly not eliminated thereby. Apart from the additional time required for the separate control or adjustment functions, the inaccuracies necessarily resulting from individual adjustments can become additive and have a negative effect on the printing quality, necessitating, in turn, further corrective adjustments.

Furthermore, as a result of German Published Application No. 2 227 151, a change-over arrangement for a device for gripping paper sheets, particularly in a sheet-turning device for multicolor printing presses, has been disclosed. Both printing units are changed-over by gear-wheels for a format adjustment or change-over so that the grippers of the transfer cylinder arrive in an appropriate transfer position for the next transfer cylinder. By rotation of an additional gear wheel which is connected to the support tube of the suction member, the suction members are coadjusted and thereby continually held in a constant position with respect to the grippers of the next-following transfer drum.

This known device thus includes only part of the change-over means, the change-over of the remaining functions, i.e. adjustment of the gripper release cams both for printing on a single side of the sheet and perfector printing, must be accomplished by separate means, so that the aforedescribed inaccuracies and danger due to the individual adjustments still remain. Furthermore, a construction of this type cannot be used for printing machines of modern design which are furnished with an encapsulated cylinder drive that is rinsed with oil or immersed in an oil bath, since the driving gear wheels are located outside the side walls.

Starting from this state of the art, it is an object of the invention of the instant application to provide a problem-free change-over device for a storage drum which perforce assures the accuracy provided at the manufacture thereof and previously adjusted during the assembly thereof, of single-side printing as well as double-side printing of a sheet or perfector printing, permitting processing of all required format sizes. It is a further object of the invention to combine all change-over processes or adjustments and to effect the entire change-over by means of only a single control element from a location outside the printing press, with as small an adjustment path as possible, all indications being readable from a common scale or indicator for better supervision. It is an additional object of the invention, to avoid any danger or possibility of damage to the printing press and to guard against all errors in adjustment or change-over operations by safety devices. It is yet another object of the invention to minimize the cost of the construction compared to that of previous devices of this general type, and to keep the responsibility of the operating personnel within tolerable limits.

Furthermore, it is an object of the invention to provide such a device with an optimal life-span of the gripper elements theref that is assured.

With the foregoing and other objects in view, there is provided in accordance with the invention, in an assembly of a sheet-transfer drum, a sheet-turning drum and a storage drum located therebetween for transporting a sheet between individual printing units of a rotary printing press, a change-over mechanism for converting the printing press from single-side sheet printing to double-size perfector printing and conversely as well as to different format size, the change-over mechanism comprising a control shaft axially displaceable to at least first and second control positions, first and second control pinions mounted on the control shaft, a plurality of drive wheels couplable with the first control pinion, in the first control position of the control shaft for converting the printing press from single-side sheet printing to double-side perfector printing, sheet guidance and holding means disposed on the storage drum, gripper release means for adjusting the format size for perfector printing, and a control member coupled with the gripper release means, the first control pinion, in the second control position of the control shaft, meshing with one of the drive wheels for adjusting the sheet guidance and holding means, and the second control pinion, in the second control position of the control shaft, meshing with the control member for adjusting the format size.

By the combination of the change-over or adjustment of all individual functions from a common location outside the printing press and by means of only a single adjustment or control member, the highest possible precision or accuracy during the printing operation is assured. In addition, as a result of the good supervision and easy serviceability of the change-over means, and as a result of the short change-over path, the down time due to change-over is considerably reduced and hence the productivity of the machine enhanced. Due to the simple and readily manufacturable construction of the device of the invention, the manufacturing cost thereof is further reduced to a minimum.

In accordance with another feature of the invention, wherein the gripper-release means comprises a cam having a surface substantially coaxial with the storage drum and varying very slightly in radial distance from the axis of the storage drum, the cam surface forming a track having a small inclination relative to the length thereof.

Thus, upon impact of the cam rolls with and roll-off thereof from the gripper release cam, the ensuing mass forces are kept to a minimum so that the release or opening of the grippers is reduced to an absolute minimum, the wear of the members effecting release or opening of the gripper being thereby considerably reduced.

In accordance with a further feature of the invention, which includes stop means for arresting the control shaft in an inactive position and in the first and second control positions thereof.

By these means all adjustment procedures are made safe, avoiding any errors in the adjustments, so that the operating personnel are largely relieved of their responsibility, which is advantageous for the operating safety of the machine.

It is yet another feature of the invention to permit adjustment or determination of the gripper release time in the simplest possible manner for perfector printing or printing on both sides of a sheet. Therefore, in accordance with an additional feature of the invention, there is provided a first side wall through which the control shaft extends from the outside of the mechanism, the second control pinion being mounted on an end of the control shaft at the inner side of the first side wall, a bearing bushing disposed in the first side wall, the control member coupled with the gripper-release means being rotatably mounted on the bearing bushing, the second control pinion being meshable with the control member, a clamping bolt disposed on the first side wall forward of the transfer drum, as viewed in travel direction of a sheet, and a clamping screw located on the outer side of the first side wall, the control member being tightenable to the inner side of the first side wall by the clamping bolt and the clamping screw.

For reasons of easy serviceability and for a more rapid system change-over of the machine as well as to obtain greater accuracy during change-over, there is provided, in accordance with an added feature of the invention, on a drive wheel of the machine, a scale or indicator with a fixing device for indicating both printing on a single side of a sheet and perfector printing, all adjustment operations of the change-over mechanism being settable on the scale device and being readable therefrom.

This permits a precise adjustment and read-off of all change-over values in the most rapid fashion, which, in turn, considerably reduces the time for a change-over operation.

Other features which are considered as characteristic for the invention are set forth in the appended claims.

Although the invention is illustrated and described herein as embodied in change-over means for a storage drum for sheet transferral, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic front elevational view of a transfer drum, a storage drum and a turning drum in single side sheetprinting position according to the invention;

FIG. 2 is a view corresponding to that of FIG. 1, however in perfector printing position for a format of maximal size;

FIG. 5 is a front elevational view as seen from the double-drive wheel of the turning drum in perfector printing position;

FIG. 6 is a vertical cross-sectional view of FIG. 5 showing a locking device for the double-drive wheel;

FIG. 7 is a fragmentary view of the double-drive wheel similar to the view of FIG. 5, but in perfector printing position;

FIG. 8 is a fragmentary sectional view of FIG. 6 showing the double-drive wheel with fixing bolts;

FIG. 9 is a partly sectional view of the change-over device in rest position and in switching position for system adjustment without format change;

Figure 3:
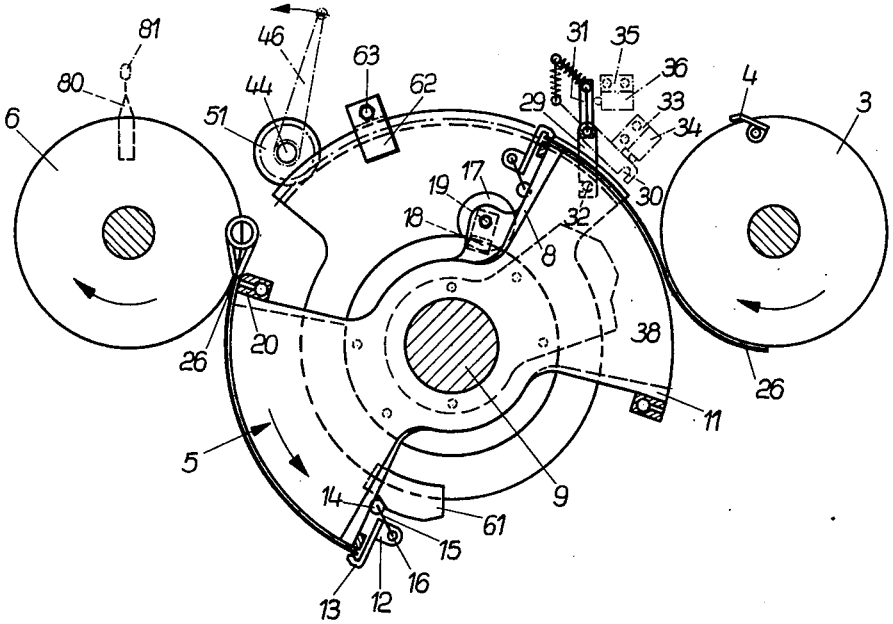
FIG. 3 is a view similar to that of FIG. 2, adjusted, however, for a format of minimal size.

Referring now to the drawings and first particularly to FIGS. 1, 2, 3 and 4 thereof, as viewed in travel direction of a sheet from the right-hand to the left-hand side of the figures, a transfer drum having grippers 4, a storage drum 5 and a turning drum 6 having clamp grippers 7, are serially mounted in side walls 1 and 2. The storage drum 5 is formed of rigid forward segments 8, which are firmly connected to a shaft 9 by means of conical pins 10 (FIG. 2) and of turnable rear segments 11, which are rotatably disposed on the shaft 9.

Figure 4:
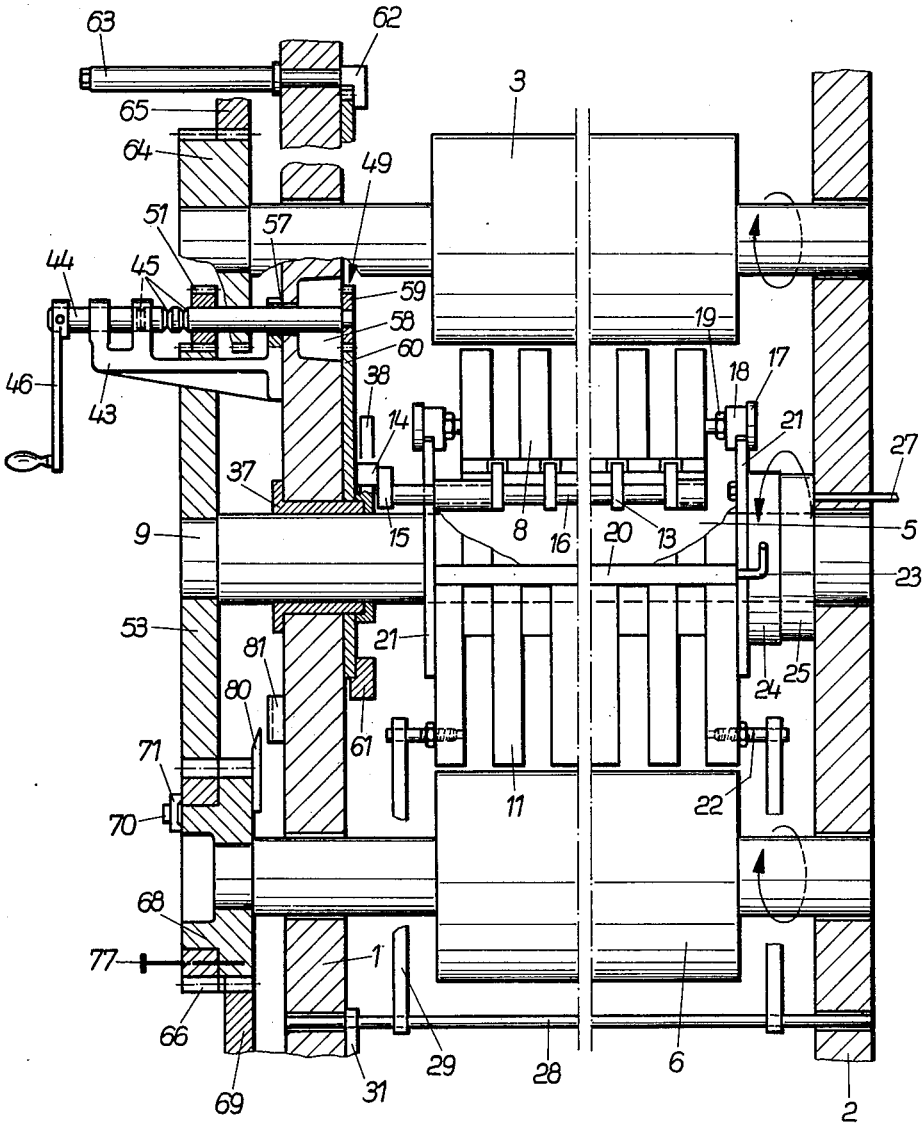
FIG. 4 is a partial cross-sectional view of the transfer drum, storage drum and turning drum with a drive and change-over device.
Figure 11:
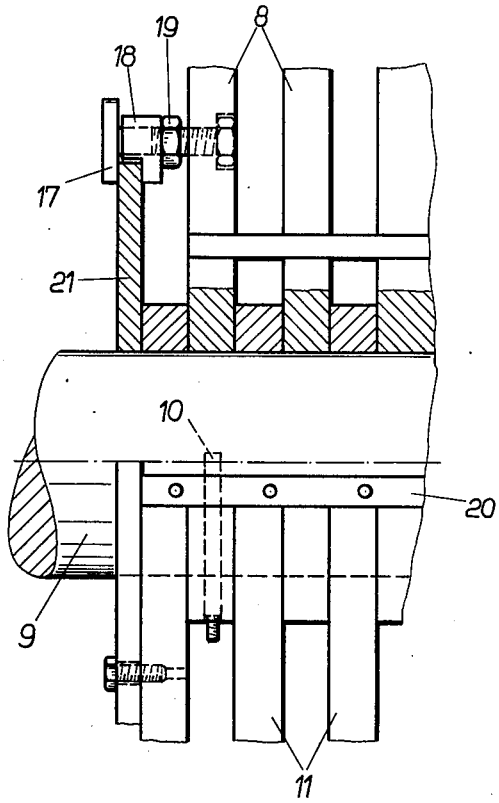
FIG. 11 is a fragmentary sectional view of FIG. 4 showing the front- and rear storage drum segments with a clamping connection.

A gripper bridge 12 with grippers 13 is screwed onto the forward segments 8. For controlling the grippers 13, there are provided cam rolls 14 which are attached by means of a cam lever 15 to a gripper shaft 16. The two outer forward segments 8 are provided with positioning or adjusting pins 17, on which shims 18 are disposed which are attachable thereto by means of clamping nuts 19. A suction bar 20 is screwed to the rear segments 11, and a flange 21 and bolt 22 are screwed to both outer rear segments 11, as seen in FIGS. 4 and 11. The suction bar 20 is connected to a valve disc 24 through the intermediary of a connecting tube 23, which is secured by means of threaded fasteners to the one flange 21 located adjacent the side wall 2, and is thereby indirectly secured to the rear segments 11. Between the valve disc 24 and the side wall 2, a control disc 25 is disposed for controlling suction air to retain the trailing edge 26 of a sheet, the control disc 25 being threadedly secured to the inner side of side wall 2 and connected by an air suction connector 27 to a non-illustrated vacuum-producing system.

As shown in FIG. 4, a bar 28 is mounted in the side walls 1 and 2 behind the sheet-turning drum 6, as viewed in direction of sheet travel, and extends along the entire width of the drum 6. Between the side walls 1 and 2 and the two outer rear segments 11, claws 29 are secured to the bar 28, and are formed with respective stop detents or recesses 30, as shown in FIGS. 3 and 4. A spring-loaded elbow-shaped or toggle lever 31, is fastened at the inner surface of the side wall 1 and is pivotable on the rod 28. As shown in FIGS. 2 and 3, there is disposed below the claw 29 a safety bolt 32 and above it a limit switch 34 attached to a holder 33. Forward of the pivot point of the spring-loaded elbow-shaped lever 31, a limit switch 36, also supported by a holder 35, is provided.

As is shown in FIGS. 1 and 4, a rocker arm with two gripper cams 38 and 39 is disposed on a bearing bushing 37 of the shaft 9, within the side wall 1, the gripper shaft 16 being controlled by the gripper cams 38 and 39. The gripper cam 38 is used both for single-side sheet printing as well as for double-side perfector printing, whereas the gripper cam 39 is used only for single-side sheet printing and is swung away by non-illustrated means during double-side perfector printing.

At the outer side of the left side wall 1, as viewed in FIG. 4, a bearing 43 is fastened, in which a control shaft 44 is rotatably mounted (also see FIG. 9). The control shaft 44 is formed with three stop notches 45 and is axially displaceable into a stop position 47 and two control positions 48 (FIG. 9) and 49 (FIG. 4) by means of a crank 46 attached to an end thereof. A compression spring-loaded ball stop 50 (FIG. 9) is mounted in a supporting wall of the bearing 43. To the right-hand side of the stop notches 45, as viewed in FIG. 9, a first control pinion 51 is mounted on the control shaft 44. Approximately midway between the control pinion 51 and the side wall 1, a ring 52 is rigidly mounted on the control shaft 44. Above the control shaft 44 and within the range of axial displacement of the ring 52, a limit switch 54 is disposed. An electromagnet coil with an armature or plunger 56 is secured at the exterior of the side wall 1.

As shown in FIG. 4, the side wall 1 is formed with a through bore 57 and with a circular recess 58 at the inner side thereof, through which the control shaft 44 extends. At the end of the control shaft 44 within the side wall 1, a second control pinion 59 is secured which, in the control position 49 of the control shaft 44, is in meshing engagement with a control member 60, preferably formed as a toothed segment having outer teeth and rotatably mounted on the bearing bushing 37.

Figure 10:
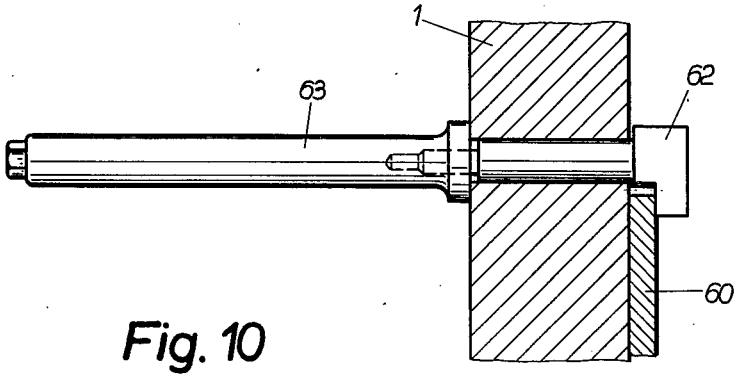
FIG. 10 is an enlarged fragmentary sectional view of FIG. 4, showing locking adjustment means for the position member.

A gripper-release cam 61 for perfector printing is fastened to the control member or toothed segment 60. As shown in FIG. 10 and as seen in travel direction of a sheet as in FIGS. 2 and 3, forward of the transfer drum 3, there is disposed in the side wall 1 a clamping bolt 62 and on the outside thereof a clamping screw 63, by means of which the turnable toothed segment 60 can be rigidly clamped. In FIG. 4, the drive for the individual drums, is shown. Outside the side wall 1, a drive wheel or gear 64 is fastened to the end of the shaft of the sheet transfer drum 3 and meshes with a drive wheel 65 of a preceeding non-illustrated impression cylinder of a first printing unit as considered in travel direction of a sheet. A drive wheel 53 for the storage drum 5 is securely mounted on a reduced-diameter end of the shaft 9. On the one hand, it engages an outer portion of the drive wheel 64 and, on the other hand, meshes with a toothed or gear rim or crown 66.

As shown in FIGS. 5 and 6, a drive wheel 68 is attached by means of threaded fasteners 67 to an end of the shaft of the sheet turning drum 6, the drive wheel 68 meshing with a drive wheel 69 (FIG. 4) of a non-illustrated impression cylinder of a second printing unit of the press. The gear crown 66 is tightly secured to a projection of the drive wheel 68 by means of clamping screws 70 and clamping paws 71. A scale ring 72 is additionally screwed to the front of the gear crown 66, a mark 73 on one of the clamping paws 71 being associated with the scale ring 72. The scale ring 72 and the toothed crown 66 are respectively formed with bores 74 and 75, in which a stop pin 77 loaded by a compression spring 76 is disposed. The front surface of the projection of the drive wheel 68 is formed with a respective fixing bore 78 for single-side sheet printing and a fixing bore 79 for printing on both sides of the sheet or perfector printing. To the smooth side of the drive wheel 68 a pointer 80 is attached and a zero mark 81 located outside the side wall 1 is associated with the pointer 80. The operation of the aforedescribed invention is described hereinafter in greater detail.

The drive is effected through the drive wheel 65 of a non-illustrated impression cylinder of the non-illustrated first printing unit and is continuously transmitted through the drive wheel 64, which has a width double that of the driving wheel 65, through the drive wheel 53 as well as through the toothed crown 66 and the drive wheel 68 to the drive wheel 69 of a non-illustrated impression cylinder of the second printing unit.

To change the system of operation of the printing press or machine from single-side sheet printing to printing on both sides of a sheet or perfector printing at maximal format size, the following change-over steps are required:

The press or machine must first be advanced stepwise to the zero mark inscribed at the outside of the side wall 1. Fine adjustment is thereby effected with the crank 46. Through axial displacement of the control shaft 44 to the first control position 48 of the control shaft 44, the first control pinion 51 is brought into meshing engagement with the drive wheel 53 of the storage drum 5. When the ball stop 50 snaps into the stop notch 45 associated with the control position 48 of the control shaft 44, the pointer 80 attached to the drive wheel 68 of the sheet-turning drum 6 is to be turned by means of the crank 46 exactly to the zero mark 81.

Thereafter, the clamping of the toothed wheel 66 to the drive wheel 68 of the sheet-turning drum 6 must be released by loosening the clamping screws 70 of the clamping paws 71, whereby the first printing unit, including the sheet transfer drum 3 and the storage drum 5, is separated from the remainder of the machine or press. The drive wheel of the storage drum 5 remains engaged, however, with the gear crown 66 of the drive wheel 68 of the reversing drum 6, the gear crown 66 being now rotatable due to the loosening or release of the clamping paws 71.

The gripping cam 39 applicable only for single-side sheet printing is swingable below the track of the cam rolls 14 by non-illustrated means.

The change-over per se from single-side sheet printing to printing on both sides of the sheet or perfector printing can now be effected. To accomplish this, the stop pin 77 of the gear crown 66 must first be lifted from the bore 78, which determines the single-side sheet printing position. Thereafter, the toothed crown 66 is rotated by means of the crank 46 until the stop pin 77 snaps into the fixing bore 79 provided for perfector printing or printing on both sides of a sheet. This change-over or adjustment can be read from the scale ring 72 in connection with the mark 73 provided on the clamping paw 71.

During the change-over, the non-illustrated first printing unit, inclusive of the sheet-transfer drum 3 and the storage drum 5, is rotated through a given phase in a direction opposite to the operating direction of the remainder of the machine so that the trailing edges of the sheet 26 are associated with the clamping grippers 7 of the sheet-turning drum 6. The exact position is set by a spring-loaded stop pin 77 and a corresponding bore 79 formed in the drive wheel 68 of the reversing drum 6, as shown in FIG. 1.

During a subsequent change of format of the machine or press in the perfector printing position, the following change-over steps are to be carried out:

The rear segments 11 in the starting position then fixed by the stop pin 77 must first be arrested. This is accomplished by manually snapping the bolts or pins 22 fastened to both outer rear segments 11 into the stop recesses 30 formed in the claws 29 attached to the rod 28. The axial displacement of the control shaft 44 to the second control position 49 of the control shaft 44 is prevented by the plunger 56 of the electromagnet 55 which is controlled by the limit switch 36. Only upon complete snapping-in of the claws 29 through the spring-loaded elbow-shaped lever 31, is the limit switch 36 depressed, releasing a lock by lifting the magnet plunger 56 and thus releasing the second control position 49 of the control shaft 44 for a change of format.

Thereafter, the clamping connection of the flange 21 of the rear segment 11 to the forward segments 8 is released. This requires release of the clamping nuts 19 disposed on respective positioning bolts or adjusting pins 17. The crank 46 must then be displaced axially to the control position 49 of the control shaft 44. This results in the engagement of the first control pinion 51 with the toothing of the drive wheel 53 of the storage drum 5, and meshing of the second control pinion 59 with the toothed segment or control member 60. Thus, a connection is made through the first control pinion 51 and the drive wheel 53 to the forward segments 8 with the grippers 13 and through the second control pinion 59 and the control member or toothed segment 60 with the gripper-release cam 61 for printing on both sides of a sheet or perfector printing.

Then, the clamping screw 63 and, accordingly, the clamping connection of the control member or toothed segment 60 with the side wall 1 must be released. The control member or toothed segment 60 with the gripper-release cam 61 fastened thereto thereby becomes freely rotatable again.

Upon lifting the stop pin 77 out of the bore 79 which fixes the perfector printing position, format adjustment can now be effected through the crank 46 and read from the scale ring 72. The forward segments 8 with the grippers 13 are thus turned to the desired format through the drive wheel 53 of the storage drum 5 and through the toothed segment 60 with the gripper release cam 61 for perfector printing opposite the direction of rotation. Through the indirect rigid connection between the valve disc 24 of the air control valve and the rear segments 11 with the suction bar 20, adjustment of the suction control timing is automatically taken into consideration in the change-over process.

After this change or adjustment of format, the flanges 21 at both sides of the rear segments 11 must be clamped again to the forward segments 8 by tightening all of the clamping nuts 19. Furthermore, by means of the clamping screws 7, the toothed crown 66 is again clamped through the clamping paws 71 to the drive wheel 68 of the sheet-turning drum 6, and the toothed segment or control member 66 is again secured by the clamping screws 63.

Thus all connections in the new position of the machine or press have been re-established.

Prior to terminating the arrest of the rear segments 11, the control shaft 44 must be displaced axially by means of the crank 46 into the control position 48 of the control shaft 44. Then, the claws 29 fastened to the rod 28 are lifted from the lateral bolts or pins 22 of the rear sheet-supporting segments 11, thus releasing the limit switch 36 and depressing the limit switch 34. As a result of the release of the limit switch 36, the meagnet plunger 56 is so controlled that the second control position 49 of the control shaft 44 for format change or adjustment again becomes blocked. Upon a subsequent axial displacement of the control shaft 44 to the uncoupled or inactive stop position 47 of the control shaft 44, the second limit switch 54 for safety of the machine or press is depressed by means of the ring 52 fastened to the control shaft 44 which, together with the limit switch 34, releases the machine or press for electrical operation.

After switching on the assembly producing suction for the suction bar 20 at the trailing edge of the sheet, the machine or press is again ready for operation.

The change-over from perfector printing or printing on both sides of the sheet to printing on only one side of the sheet is effected in reverse sequence.

I claim:

1. In an assembly of a sheet-transfer drum, a sheet-turning drum and a storage drum located therebetween for transporting a sheet between individual printing units of a rotary printing press having two side walls disposed opposite and spaced from one another, the drums being disposed in the space between and journalled in the two side walls, the storage drum being mounted on a shaft and comprising forward sheet carrying means fixed to said shaft and rear sheet carrying means rotatable relative to said shaft, said rear sheet carrying means being lockable relative to said forward sheet carrying means, a change-over mechanism for converting the printing press from single-side sheet printing to double-side perfector printing and conversely as well as to different format sizes, the change-over mechanism being provided exclusively in that drum of the assembly of drums which is the storage drum and comprising a control shaft extending from a location outside said change-over mechanism through one of said side walls and being axially displaceable to at least first and second control positions, first and second control pinions mounted on said control shaft, a plurality of drive wheels couplable with said first control pinion, in said first control position of said control shaft for converting the printing press from single-side sheet printing to double-side perfector printing, means for guiding and holding a sheet disposed on the storage drum, gripper-release means for adjusting the format size for perfector printing, and a control member coupled with said gripper-release means, said first control pinion, in said second control position of said control shaft, meshing with one of said drive wheels for adjusting said means for guiding and holding a sheet, and said second control pinion, in said second control position of said control shaft, meshing with said control member for adjusting the format size.

2. Change-over mechanism according to claim 1 wherein said gripper-release means comprises a cam having a surface substantially coaxial with the storage drum and varying in radial distance from the axis of the storage drum, said cam surface forming a track having an inclination that is small relative to the length of said track.

3. Change-over mechanism according to claim 1 including stop means for arresting said control shaft in an inactive position and in said first and second control positions thereof.

4. Change-over mechanism according to claim 1 including safety means for preventing operation of the printing press when there is an error in the adjustment of said first and second control positions of said control shaft.

5. Change-over mechanism according to claim 1 wherein said two side walls include a first side wall through which said control shaft extends from the outside of the mechanism, said second control pinion being mounted on an end of said control shaft at the inner side of said first side wall, a bearing bushing disposed in said first side wall, said control member coupled with said gripper-release means being rotatably mounted on said bearing bushing, said second control pinion being meshable with said control member, a clamping bolt disposed on said first side wall forward of the transfer drum, as viewed in travel direction of a sheet, and a clamping screw located on the outer side of said first side wall, said control member being tightenble to the inner side of said first side wall by said clamping bolt and said clamping screw.

6. Change-over mechanism according to claim 1 wherein the printing press includes drive wheel means for rotating at least the sheet-turning drum, and a scale device having fixing means mounted on said drive wheel means for selectively indicating perfector printing and single-side sheet printing, all adjustment operations of the change-over mechanism being settable on said scale device and being readable therefrom.

7. Change-over mechanism according to claim 1 wherein said gripper-release means is a gripper-release cam, said control member being a gear segment formed with outer teeth for adjusting the format through said gripper-release cam.

8. In an assembly of a sheet-transfer drum, a sheet-turning drum and a storage drum located therebetween for transporting a sheet between individual printing units of a rotary printing press, a change-over mechanism for converting the printing press from single-side sheet printing to double-side perfector printing and conversely as well as to different format sizes, the changeover mechanism comprising a control shaft axially displaceable to at least first and second control positions, first and second control pinions mounted on said control shaft, a plurality of drive wheels couplable with said first control pinion, in said first control position of said control shaft for converting the printing press from single-side sheet printing to double-side perfector printing, means for guiding and holding a sheet disposed on the storage drum, gripper-release means for adjusting the format size for perfector printing, a control member coupled with said gripper-release means, said first control pinion, in said second control position of said control shaft, meshing with one of said drive wheels for adjusting said means for guiding and holding a sheet, and said second control pinion, in said second control position of said control shaft, meshing with said control member for adjusting the format size, safety means for preventing operation of the printing press when there is an error in the adjustment of said first and second control positions of said control shaft, a first side wall into which said control shaft extends from the outside of the mechanism, and stop means for arresting said control shaft in an inactive position and in said first and second control positions thereof, and wherein said safety means comprise a ring mounted on said control shaft outside said first side wall and being axially displaceable with said control shaft over a given range of displacement, a limit switch located above said control shaft within said given range of displacement of said ring and electrically protecting said inactive position and said first control position as well as electrically releasing the operation of the printing press, and an electromagnet including a plunger mounted at the outside of said first side wall and actuable for preventing operation of the printing press when there is an error in the adjustment of said second control position.

9. Change-over mechanism according to claim 8 including means for bearing said control shaft secured to the outside of said first side wall, said control shaft being rotatably mounted in said bearing means, axially displaceable therein into said inactive position as well as said first and second control positions thereof, and arrestable in said positions, respectively, by a spring-loaded ball stop carried by said bearing means, said first control pinion being secured to said control shaft outside said first side wall, said bearing means being formed with a supporting wall for said control shaft, said axial displacement of said first control pinion in outward direction being limited by said supporting wall and, in inward direction by said ring mounted on said control shaft outside said first side wall, said ring in said inactive position of said control shaft, being in contact with said limit switch and, in said first control position, cooperating with said electromagnet plunger controllable by another limit switch, said other limit switch and said plunger cooperating to prevent operation of the printing press when there is an error in adjustment of said first control position, said first side wall being formed with a through bore and a substantially circular recess at the inner side thereof, said second control pinion being mounted on said control shaft within said substantially circular recess and being axially adjustable therein, and including a crank secured to the outer end of said control shaft and being actuable for adjusting said control shaft.

10. In an assembly of a sheet-transfer drum, a sheet-turning drum and a storage drum located therebetween for transporting a sheet between individual printing units of a rotary printing press, a change-over mechanism for converting the printing press from single-side sheet printing to double-side perfector printing and conversely as well as to different format sizes, the change-over mechanism comprising a control shaft axially displaceable to at least first and second control positions, first and second control pinions mounted on said control shaft, a plurality of drive wheels couplable with said first control pinion, in said first control position of said control shaft for converting the printing press from single-side sheet printing to double-side perfector printing, means for guiding and holding a sheet disposed on the storage drum, gripper-release means for adjusting the format size for perfector printing, and a control member coupled with said gripper-release means, said first control pinion, in said second control position of said control shaft, meshing with one of said drive wheels for adjusting said means for guiding and holding a sheet, and said second control pinion, in said second control position of said control shaft, meshing with said control member for adjusting the format size, a first side wall through which said control shaft extends from the outside of the mechanism, said second control pinion being mounted on an end of said control shaft at the inner side of said first side wall, a bearing bushing disposed in said first side wall, said control member coupled with said gripper-release means being rotatably mounted on said bearing bushing, said second control pinion being meshable with said control member, a clamping bolt disposed on said first side wall forward of the transfer drum, as viewed in travel direction of a sheet, and a clamping screw located on the outer side of said first side wall, said control member being tightenable to the inner side of said first side wall by said clamping bolt and said clamping screw, a second side wall juxtaposed with said first side wall, a storage drum shaft supported in said bearing bushing and extending between said first and second side walls, the storage drum comprising forward sheet carrying means fixedly mounted on said storage drum shaft and rear sheet carrying means rotatably mounted on said storage drum shaft, arresting means provided on said first and second side walls and on said rear sheet carrying means, safety means cooperating with said arresting means for preventing operation of the printing press when there is an error in adjustment of said control positions, and clamping means located at said forward sheet carrying means for clamping said rotatable rear sheet carrying means to said fixed forward sheet carrying means.

11. Change-over mechanism according to claim 10 wherein said clamping means comprise adjusting pins respectively fastened to said fixed forward sheet carrying means, respective shims disposed on said adjusting pins, and respective clamping nuts adjustably securing said shims to said adjusting pins, respectively, said arresting means also including respective flanges secured to said rotatable rear sheet carrying means, said flanges being clampable by said shims and said clamping nuts to said fixed forward sheet carrying means.

12. In an assembly of a sheet-transfer drum, a sheet-turning drum and a storage drum located therebetween for transporting a sheet between individual printing units of a rotary printing press, a change-over mechanism for converting the printing press from single-side sheet printing to double-side perfector printing and conversely as well as to different format sizes, the change-over mechanism comprising a control shaft axially displaceable to at least first and second control positions, first and second control pinions mounted on said control shaft, a plurality of drive wheels couplable with said first control pinion, in said first control position of said control shaft for converting the printing press from single-side sheet printing to double-side perfector printing, means for guiding and holding a sheet disposed on the storage drum, gripper-release means for adjusting the format size for perfector printing, a control member coupled with said gripper-release means, said first control pinion, in said second control position of said control shaft, meshing with one of said drive wheels for adjusting said means for guiding and holding a sheet, and said second control pinion, in said second control position of said control shaft, meshing with said control member for adjusting the format size, a first side wall through which said control shaft extends from the outside of the mechanism, said second control pinion being mounted on an end of said control shaft at the inner side of said first side wall, a bearing bushing disposed in said first side wall, said control member coupled with said gripper-release means being rotatably mounted on said bearing bushing, said second control pinion being meshable with said control member, a clamping bolt disposed on said first side wall forward of the transfer drum, as viewed in travel direction of a sheet, and a clamping screw located on the outer side of said first side wall, said control member being tightenable to the inner side of said first side wall by said clamping bolt and said clamping screw, a second side wall juxtaposed with said first side wall, a storage drum shaft supported in said bearing bushing and extending between said first and second side wall, the storage drum comprising forward sheet carrying means fixedly mounted on said storage drum shaft and rear sheet carrying means rotatably mounted on said storage drum shaft, arresting means provided on said first and second side walls and on said rear sheet carrying means, safety means cooperating with said arresting means for preventing operation of the printing press when there is an error in adjustment of said control positions, and clamping means located at said forward sheet carrying means for clamping said rotatable rear sheet carrying means to said fixed forward sheet carrying means, a bar rotatably mounted in said first and second side wall behind the sheet-turning drum, as viewed in travel direction of a sheet, and extending transversely along the entire length of the sheet-turning drum, a plurality of claws formed with stop recesses at respective ends thereof being secured to said bar between said first and second side walls and adjacent said rear sheet carrying means, a spring-loaded elbow lever, and bolt means fastened to said rear sheet carrying means, said claws being engageable through said spring-loaded elbow lever with said bolt means.

13. Change-over mechanism according to claim 12 including a safety bolt for protection against accidental actuation of said arresting means during operation of the printing press, said safety bolt being disposed below one of said claws, first and second holder means, a first limit switch secured by said first holder means above said claws, and a second limit switch secured by said second holder means forward of a pivot point of said spring-loaded elbow lever, said first and second limit switches serving to electrically protect said arresting means and both said first and second control positions of said control shaft.

14. In an assembly of a sheet-transfer drum, a sheet-turning drum and a storage drum located therebetween for transporting a sheet between individual printing units of a rotary printing press, a change-over mechanism for converting the printing press from single-side sheet printing to double-side perfector printing and conversely as well as to different format sizes, the change-over mechanism comprising a control shaft axially displaceable to at least first and second control positions, first and second control pinions mounted on said control shaft, a plurality of drive wheels couplable with said first control pinion, in said first control position of said control shaft for converting the printing press from single-side sheet printing to double-side perfector printing, means for guiding and holding a sheet disposed on the storage drum, gripper-release means for adjusting the format size for perfector printing, a control member coupled with said gripper-release means, said first control pinion, in said second control position of said control shaft, meshing with one of said drive wheels for adjusting said means for guiding and holding a sheet, and said second control pinion, in said second control position of said control shaft, meshing with said control member for adjusting the format size, drive wheel means for rotating at least the sheet-turning drum, and a scale device having fixing means mounted on said drive wheel means for selectively indicating perfector printing and single-side sheet printing, all adjustment operations of the change-over mechanism being settable on said scale device and being readable therefrom, said one drive wheel with which said first control pinion meshes, in said second control position of said shaft, being the drive wheel of the storage drum, and said drive wheel means for said sheet-turning drum having an extension, a toothed crown mounted on said extension, said toothed crown being in meshing engagement with said drive wheel of the storage drum, and said toothed crown being in meshing engagement with and rotatable by said first control pinion, means including threaded fasteners and clamping paws securing said toothed crown to said extension, said scale device including marking means provided on one of said clamping paws and associated with said toothed crown, a zero marking disposed on the outside of said first side wall, and pointer means located on said drive wheel means for said sheet-turning drum at a side thereof facing said first side wall.

15. Change-over mechanism according to claim 14 wherein said scale device and said toothed crown are formed with respective bores, spring-loaded stop pin means received in said bores, said fixing means of said scale device comprising two fixing bores formed in said drive wheel means of said sheet-turning drum, the storage drum being selectively lockable in position in one of said two fixing bores for effecting single-side sheet printing and perfector printing, respectively.

* * * * *